US008298475B2

(12) United States Patent
Tseng

(10) Patent No.: US 8,298,475 B2
(45) Date of Patent: Oct. 30, 2012

(54) HIGH TEMPERATURE AND ECONOMIZING FURNACE SYSTEM

(75) Inventor: Chang Lung Tseng, Changhua (TW)

(73) Assignee: King Yuan Dar Metal Enterprise Co., Ltd., Hsiensi, Changhua (TW)

( * ) Notice: Subject to any disclaimer, the term of this patent is extended or adjusted under 35 U.S.C. 154(b) by 183 days.

(21) Appl. No.: 12/925,680

(22) Filed: Oct. 27, 2010

(65) Prior Publication Data

US 2012/0104667 A1 May 3, 2012

(51) Int. Cl.
*C21D 11/00* (2006.01)

(52) U.S. Cl. ..... 266/156; 266/252

(58) Field of Classification Search ..... 266/249, 266/252, 257, 156; 432/176, 152
See application file for complete search history.

(56) References Cited

U.S. PATENT DOCUMENTS

| | | | | |
|---|---|---|---|---|
| 4,227,874 | A | 10/1980 | Nugent | |
| 4,582,301 | A * | 4/1986 | Wunning | 266/87 |
| 4,767,320 | A * | 8/1988 | Sasaki et al. | 432/59 |
| 5,848,890 | A | 12/1998 | McCormick | |
| 7,520,746 | B1 * | 4/2009 | Johnston et al. | 432/128 |

* cited by examiner

*Primary Examiner* — Scott Kastler
(74) *Attorney, Agent, or Firm* — Charles E. Baxley

(57) ABSTRACT

A furnace system includes a furnace facility disposed on a conveyer device and having a pre-heating zone, a high temperature heating zone, and two cooling zones, and the conveyer device moves the work piece from the pre-heating zone through the high temperature heating zone and the cooling zones, two heating members disposed in the heating zones for pre-heating and heating the work piece, two piping members coupled between the cooling zones and the heating zones for recycling the waste heat gas, and two blowing devices draw the waste gas from the cooling zones to the heating zones for recycling and economizing the heat energy and for preventing the steel materials from being distorted or twisted.

1 Claim, 4 Drawing Sheets

HIGH TEMPERATURE AND ECONOMIZING FURNACE SYSTEM

BACKGROUND OF THE INVENTION

1. Field of the Invention

The present invention relates to a furnace system, and more particularly to a high temperature and economizing furnace system including a pre-heating zone and a high temperature heating zone and one or more cooling zones for suitably heating the high chromium steel and for allowing the high chromium steel to have a compact and solid structure.

2. Description of the Prior Art

Typical steel materials, such as the high chromium steel materials or plates comprise a number of slits or slots or gaps formed or provided therein while subjected with various heating processes or procedures with various kinds of furnace facilities, such that the strengths of the typical high chromium steel materials are low or are not good enough to make products and may become defective products.

For solving such problems, the skilled technicians use or employ a high temperature to heat the typical high chromium steel materials and to have the slits or slots or gaps formed or provided in the typical high chromium steel materials filled with the steel materials and to have a compact and solid structure such that the strengths of the typical high chromium steel materials may be suitably increased and may be used and made into various kinds of products.

For the typical high chromium steel material heating furnaces, the high chromium steel materials or plates are required to be disposed or engaged into the typical steel furnaces for heating the high chromium steel materials or plates to the required higher temperature and for allowing the slits or slots or gaps formed or provided in the typical high chromium steel materials or plates to be filled with the steel materials and to have a compact and solid structure.

However, after the heating operations, the heated high chromium steel materials or plates should be removed from the typical steel furnaces for cooling purposes, and a number of skilled technicians and man working hours are required to move the typical high chromium steel materials or plates into and out of the typical steel furnaces such that manufacturing procedures and cost will be greatly increased.

U.S. Pat. No. 4,227,874 to Nugent, and U.S. Pat. No. 5,848,890 to McCormick disclose two of the typical furnace product supporting or transporting devices for supporting or transporting the typical high chromium steel materials or plates into and out of the typical steel furnaces.

However, the typical furnace product supporting or transporting devices may only be used to support or to transport the typical high chromium steel materials or plates into and out of the typical steel furnaces, but may not be used to move or to transport the typical high chromium steel materials or plates between heating zones and/or cooling zones.

In addition, without pre-heating processes or procedures, the typical high chromium steel materials or plates will be quickly heated to a very high temperature and may have a good chance to be distorted or twisted and will become a defect product. Furthermore, the heat energy generated during the heating processes or procedures may not be recycled or reused such that a number of heat energy will be wasted.

The present invention has arisen to mitigate and/or obviate the afore-described disadvantages of the conventional steel furnace systems.

SUMMARY OF THE INVENTION

The primary objective of the present invention is to provide a high temperature and economizing furnace system including a high temperature heating zone and one or more cooling zones for suitably heating the high chromium steel and for allowing the high chromium steel to have a compact and solid structure.

The other objective of the present invention is to provide a high temperature and economizing furnace system including a heat energy recycling or reusing system to recycle or reuse the heat energy and to economize the heat energy.

The further objective of the present invention is to provide a high temperature and economizing furnace system including a pre-heating zone for pre-heating the high chromium steel before the high chromium steel is heated to a required or predetermined high temperature and for preventing the high chromium steel from being distorted or twisted.

In accordance with one aspect of the invention, there is provided a furnace system comprising a conveyer device for supporting and transporting a work piece, a furnace facility disposed on the conveyer device and including a pre-heating zone, a high temperature heating zone, a first cooling zone, and a second cooling zone, and the conveyer device being provided for transporting and moving the work piece from the pre-heating zone through the high temperature heating zone and the first and the second cooling zones, a first heating member disposed in the pre-heating zone for pre-heating the work piece, a second heating member disposed in the high temperature heating zone for further heating the work piece, a first piping coupled between the first cooling zone and the pre-heating zone, a second piping coupled between the second cooling zone and the high temperature heating zone, a first blowing device disposed in the first cooling zone for drawing a waste gas from the first cooling zone to the pre-heating zone, a second blowing device disposed in the second cooling zone for drawing a waste gas from the second cooling zone to the high temperature heating zone and for recycling or reusing or economizing the heat energy, an oxygen density controller attached to the high temperature heating zone and including a probe engaged into the high temperature heating zone for detecting a density of an oxygen contained within the high temperature heating zone, and the furnace facility including a temperature control member and a timer attached to each of the pre-heating zone and the high temperature heating zone and the first and the second cooling zones respectively for monitoring a temperature of the work piece, and for controlling a time interval of the work piece within the pre-heating zone and the high temperature heating zone and the first and the second zones respectively and for preventing the high chromium steel materials or work pieces from being distorted or twisted.

The waste gas from the first cooling zone to the pre-heating zone and the first heating member pre-heat the work piece to a predetermined temperature (600° C.), and the work piece is retained in the pre-heating zone for twelve (12) hours.

The waste gas from the second cooling zone to the heating zone and the second heating member heat the work piece to a higher predetermined temperature (970° C.), and the work piece is retained in the pre-heating zone for thirty six (36) hours.

The waste gas is preferably and gradually cooled in the first cooling zone from 970 to 650° C. and retained in the first cooling zone for three (3) hours. The waste gas is preferably and gradually cooled in the second cooling zone from 650 to 50° C. and retained in the second cooling zone for nine (9) hours for preventing the high chromium steel materials or work pieces from being distorted or twisted.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
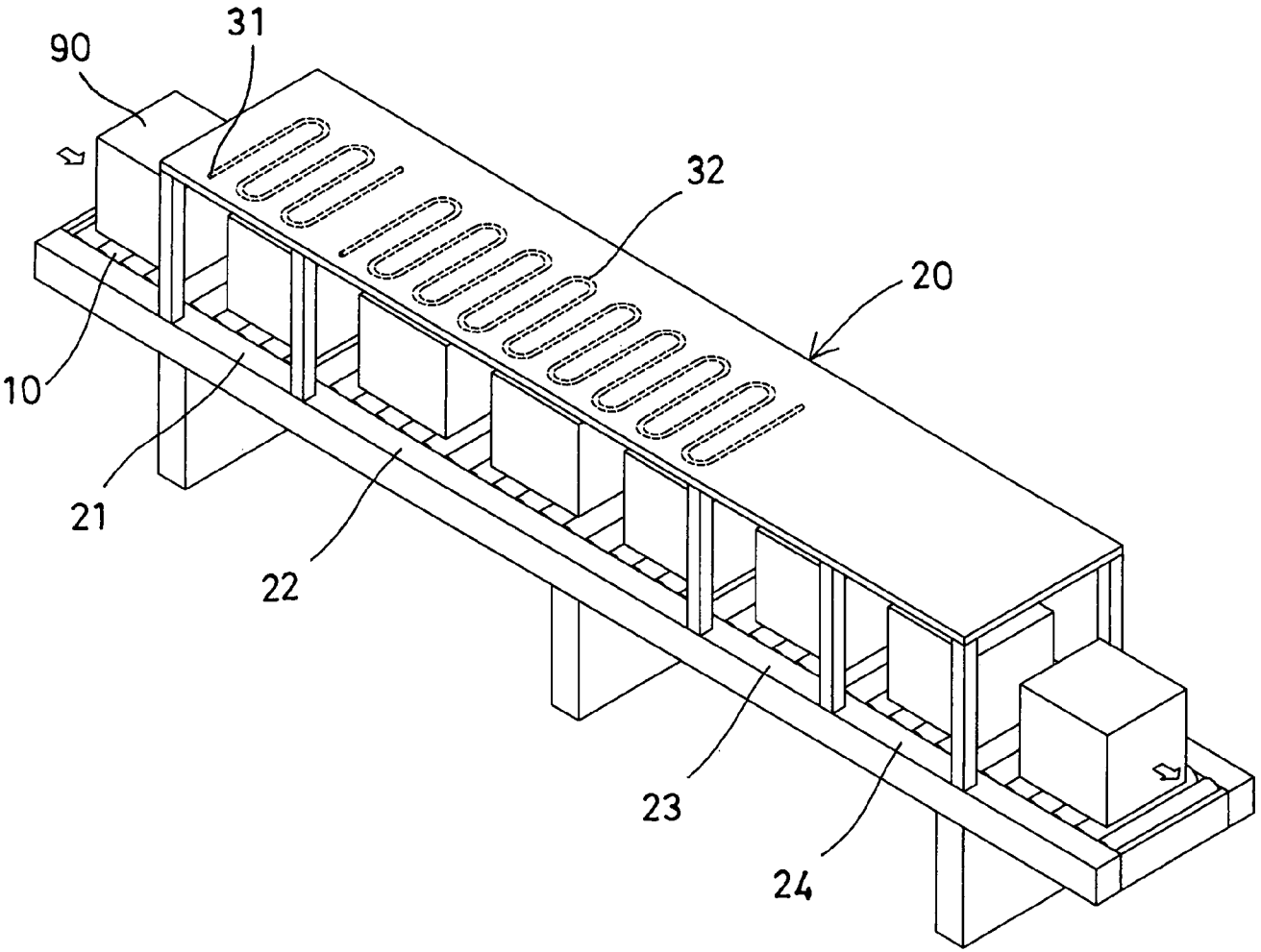
FIG. 1 is a perspective view of a furnace system in accordance with the present invention.
Figure 2:
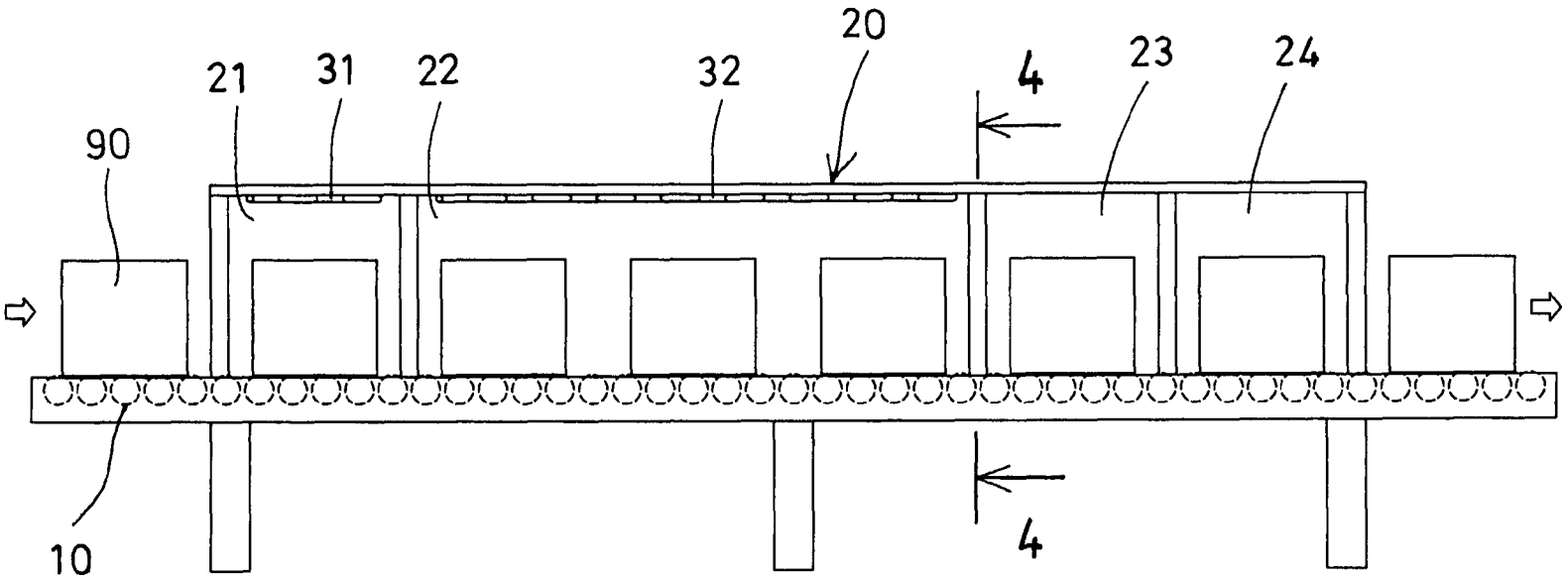
FIG. 2 is a front plan schematic view of the furnace system.
Figure 3:
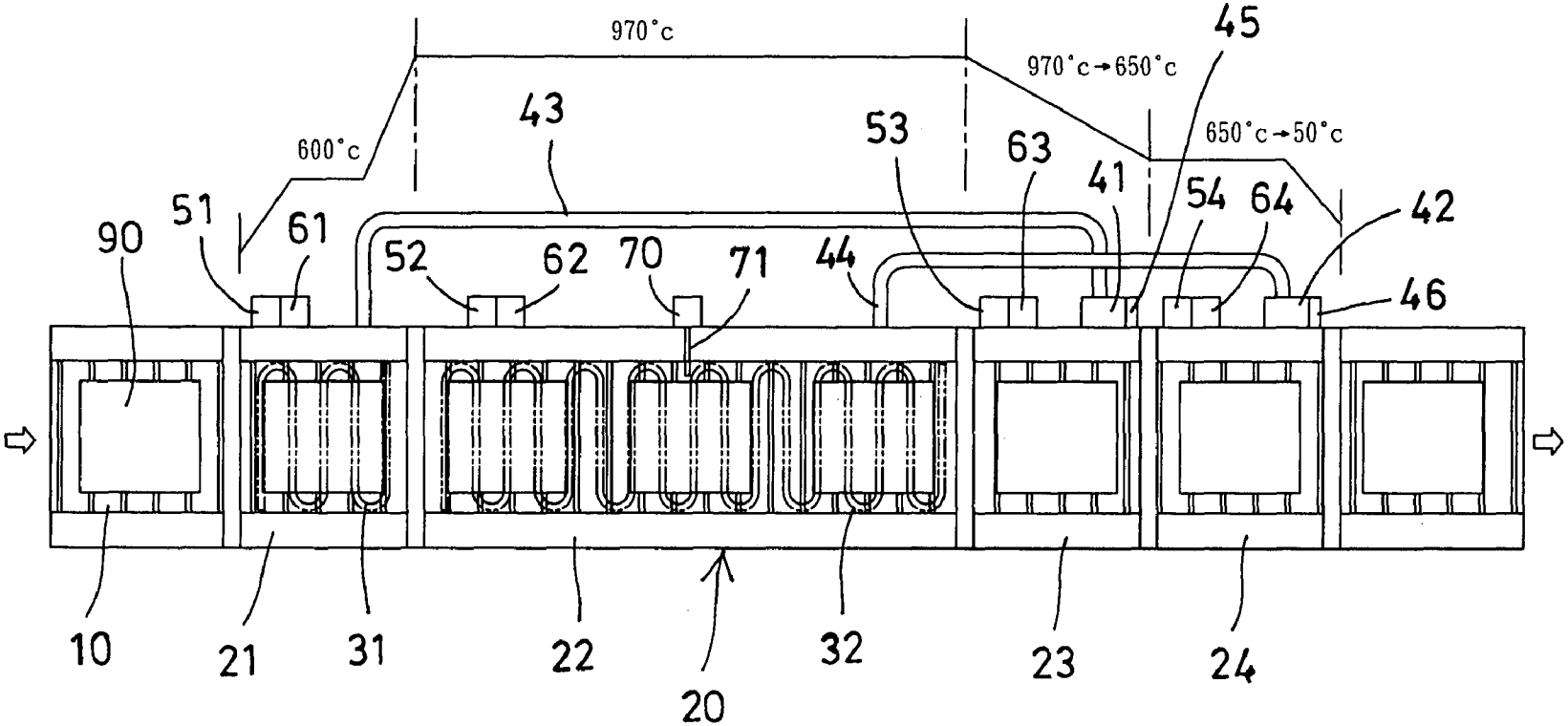
FIG. 3 is a top plan schematic view illustrating the operation of the furnace system.
Figure 4:
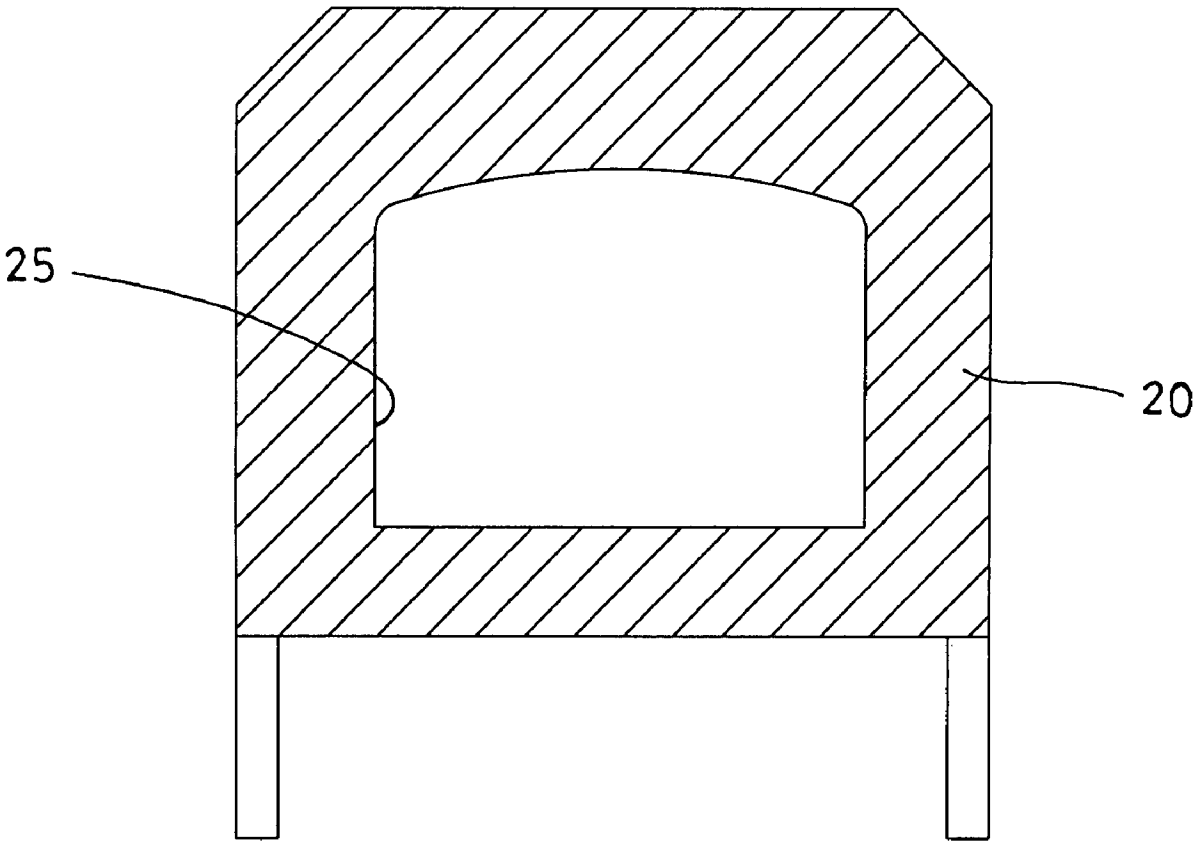
FIG. 4 is a partial cross sectional view of the furnace system taken along lines 4-4 of FIG. 1.

Referring to the drawings, and initially to FIGS. 1-3, a furnace system in accordance with the present invention comprises a belt or band or roller conveyer device 10 for supporting or transporting the high chromium steel materials or plates or work pieces 90 along the conveyer device 10, and a furnace facility 20 disposed or attached or mounted or supported on top of the conveyer device 10 and including a pre-heating zone 21, a high temperature heating zone 22 disposed or located or formed or provided or arranged behind the pre-heating zone 21, and one or more cooling zones 23, 24 disposed or located or formed or provided or arranged behind the high temperature heating zone 22, and the conveyer device 10 is provided for transporting or moving the high chromium steel materials or plates or work pieces 90 from the pre-heating zone 21 through the high temperature heating zone 22 and then toward and through the cooling zones 23, 24. As shown in FIG. 4, the furnace facility 20 includes a longitudinal chamber 25 formed therein for slidably receiving or engaging with the high chromium steel work pieces 90.

A heating device or member 31 is disposed or attached or mounted or engaged in the furnace facility 20 and located or arranged in the pre-heating zone 21 for pre-heating the high chromium steel work pieces 90 and for gradually increasing the temperature of the high chromium steel work pieces 90 to the required or predetermined temperature (about 600° C.), and another heating device or member 32 is disposed or attached or mounted or engaged in the furnace facility 20 and located or arranged in the high temperature heating zone 22 for further increasing the temperature of the high chromium steel work pieces 90 to the required or predetermined higher temperature (about 970° C.), and one or more vacuuming or drawing or blowing devices 41, 42 are disposed or attached or mounted or engaged in the furnace facility 20 and located or arranged in the cooling zones 23, 24 respectively for suitably or gradually cooling the high chromium steel work pieces 90 to the required or predetermined lower or room temperature.

A heat resistive tube or piping 43 is coupled between one of the cooling zones 23 and the pre-heating zone 21 for vacuuming or drawing the waste gas or air from the first cooling zone 23 to the pre-heating zone 21 with the blowing device 41 and for further pre-heating the high chromium steel work pieces 90 and for recycling or reusing the heat energy that may be wasted, and thus for suitably economizing the fuel or heat energy. Another heat resistive tube or piping 44 is coupled between the other cooling zone 24 and the high temperature heating zone 22 for vacuuming or drawing the waste gas or air from the second cooling zone 24 to the high temperature heating zone 22 with the blowing device 42 and for further heating the high chromium steel work pieces 90 to the required or predetermined higher temperature and for recycling or reusing the heat energy that may be wasted, and thus for further suitably economizing the fuel or heat energy. The blowing devices 41, 42 each may further include a controlling device 45, 46 attached or mounted or coupled thereto for controlling or operating or actuating the blowing devices 41, 42 to vacuum or draw the waste gas or air.

A temperature control member 51, 52, 53, 54 and a timer 61, 62, 63, 64 are disposed or attached or mounted or engaged in the furnace facility 20 and located or arranged in the pre-heating zone 21 and the high temperature heating zone 22 and the cooling zones 23, 24 respectively for suitably monitoring or controlling the temperature of the high chromium steel work pieces 90 within the required or predetermined temperature range, and for suitably controlling the timing or time interval of the high chromium steel work pieces 90 within the zones 21~24 respectively. An oxygen density controller 70 is disposed or attached or mounted or engaged in the furnace facility 20 and located or arranged in the high temperature heating zone 22, and includes a probe 71 extended or engaged into the high temperature heating zone 22 for sensing or detecting the containment or the density of the oxygen contained within the high temperature heating zone 22, and for sending the detected information to the controlling devices 45, 46 or to a processor device (not shown) in order to actuate or operate or control the blowing devices 41, 42 to vacuum or draw the waste gas or air.

In operation, as shown in FIGS. 1-3, the high chromium steel work pieces 90 are gradually transported or moved or sent into and from the pre-heating zone 21 through the high temperature heating zone 22 and then toward and through the cooling zones 23, 24. The high chromium steel work piece 90 is preferably stayed or retained in the pre-heating zone 21 for about twelve (12) hours, and gradually pre-heated to the required or predetermined temperature (about 600° C.), and then transported or moved or sent into the high temperature heating zone 22 and preferably stayed or retained in the high temperature heating zone 22 for about thirty six (36) hours, and further heated to the required or predetermined higher temperature (about 970° C.), and for allowing the slits or slots or gaps formed or provided in the high chromium steel work pieces 90 to be filled with the steel materials and to have a compact and solid structure such that the strengths of the high chromium steel work pieces 90 may be suitably increased and may be used and made into various kinds of products and will not become the defect products.

The blowing device 41 may vacuum or draw the waste gas or air (about 400~500° C.) from the first cooling zone 23 to the pre-heating zone 21 and for further pre-heating the high chromium steel work pieces 90 and for recycling or reusing the heat energy that may be wasted, and thus for suitably economizing the heat energy that is required to be generated by the heating device or member 31. It is preferable that the high chromium steel work piece 90 is stayed or retained in the first cooling zone 23 for about three (3) hours and gradually decreased to the required or predetermined temperature (from 970 to about 650° C.), and then transported or moved or sent into the other or the second cooling zone 24 and stayed or retained for about nine (9) hours and gradually decreased to the required or predetermined lower or room temperature (from 650 to about 50° C.). The blowing device 42 may vacuum or draw the waste gas or air (about 200~250° C.) from the second cooling zone 24 to the high temperature heating zone 22 and for further heating the high chromium steel work pieces 90 and for recycling or reusing the heat energy that may be wasted, and thus for suitably economizing the heat energy that is required to be generated by the heating device or member 32.

The probe 71 of the oxygen density controller 70 may sense or detect the containment or the density of the oxygen contained within the high temperature heating zone 22, and the required or predetermined oxygen containment or density is set at about twenty two (22), when the detected oxygen containment or density is below the required or predetermined value, the blowing device 42 may be actuated or operated or controlled to vacuum or draw the waste gas or air from the second cooling zone 24 to the high temperature heating zone 22 for suitably increasing the oxygen containment or density within the high temperature heating zone 22. On the contrary, when the detected oxygen containment or density is greater then the required or predetermined value, the rotational or operating speed of the blowing device 42 may be suitably decreased for suitably decreasing the oxygen containment or density within the high temperature heating zone 22, and for allowing the slits or slots or gaps formed or provided in the high chromium steel work pieces 90 to be suitably filled with the steel materials and to have a compact and solid structure, and for preventing the high chromium steel work pieces 90 from being distorted or twisted during the heating processes or procedures. The heat energy and/or the waste gas or air may be recycled or reused to economize the fuel or heat energy that is required to be generated by the heating devices or members 31, 32.

Accordingly, the high temperature and economizing furnace system in accordance with the present invention includes a high temperature heating zone and one or more cooling zones for suitably heating the high chromium steel and for allowing the high chromium steel to have a compact and solid structure, and includes a heat energy recycling or reusing system to recycle or reuse the heat energy and to economize the heat energy, and includes a pre-heating zone for pre-heating the high chromium steel before the high chromium steel is heated to a required or predetermined high temperature and for preventing the high chromium steel from being distorted or twisted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A furnace system comprising:

a conveyer device for supporting and transporting a work piece, a furnace facility disposed on said conveyer device and including a pre-heating zone, a high temperature heating zone, a first cooling zone, and a second cooling zone, and said conveyer device being provided for transporting and moving the work piece from said pre-heating zone through said high temperature heating zone and said first and said second cooling zones, a first heating member disposed in said pre-heating zone for pre-heating the work piece, a second heating member disposed in said high temperature heating zone for further heating the work piece, a first piping coupled between said first cooling zone and said pre-heating zone, a second piping coupled between said second cooling zone and said high temperature heating zone, a first blowing device disposed in said first cooling zone for drawing a waste gas from said first cooling zone to said pre-heating zone, a second blowing device disposed in said second cooling zone for drawing a waste gas from said second cooling zone to said high temperature heating zone, an oxygen density controller attached to said high temperature heating zone and including a probe engaged into said high temperature heating zone for detecting a density of an oxygen contained within said high temperature heating zone, and said furnace facility including a temperature control member and a timer attached to each of said pre-heating zone and said high temperature heating zone and said first and said second cooling zones respectively for monitoring a temperature of the work piece, and for controlling a time interval of the work piece within said pre-heating zone and said high temperature heating zone and said first and said second zones respectively.

* * * * *